United States Patent [19]

Gimelfarb et al.

[11] 4,202,664

[45] May 13, 1980

[54] METHOD FOR CLEANSING CATTLE HIDES AND APPARATUS FOR REALIZING SAME

[76] Inventors: Natan M. Gimelfarb, ulitsa Pervomaiskaya, 67, kv. 67; Fedor T. Lugovnev, ulitsa Mayakovskogo, 40, kv. 18; Nikolai E. Misjura, pereulok Treugolny, 13, all of Mogilev, U.S.S.R.

[21] Appl. No.: 855,981

[22] Filed: Nov. 30, 1977

[51] Int. Cl.[2] ..... C14C 1/00; D01C 1/00

[52] U.S. Cl. ..... 8/94.15; 8/139; 8/150.5; 69/32

[58] Field of Search ..... 8/94.15, 139, 150.5

[56] References Cited

U.S. PATENT DOCUMENTS

| | | | |
|---|---|---|---|
| 400,442 | 4/1889 | Cooper | 8/94.15 |
| 673,082 | 4/1901 | Jones et al. | 8/150.5 |
| 971,126 | 9/1910 | Fay | 8/150.5 |
| 2,869,350 | 1/1959 | Bode | 8/94.15 |
| 3,319,442 | 5/1967 | Burch | 69/42 |

FOREIGN PATENT DOCUMENTS

| | | |
|---|---|---|
| 2330767 | 8/1977 | France . |
| 308063 | 9/1971 | U.S.S.R. . |

OTHER PUBLICATIONS

Fairchild's Dictionary of Textiles (Fairchild Publications, New York), 1975, p. 103.

*Primary Examiner*—A. Lionel Clingman
*Attorney, Agent, or Firm*—Steinberg and Blake

[57] ABSTRACT

This invention relates to primary processing of animal hides and more particularly to methods for cleansing cattle hides and to apparatus for carrying out same. According to the proposed method, washing, soaking and removal of dung from the surface of the hides are carried out simultaneously and continuously under copious irrigation of the moving hides with water and the hides are then clamped in position essentially along the axis of movement, while the removal of dung is effected by carding their hair covering and subsequent removal of surface moisture. An apparatus for carrying out said method comprises a tank for washing hides, a pair of belt conveyers arranged parallel to each other, and a pair of chain conveyers for grasping a hide and clamping it along its axis with its hair covering downwards during travel, and shafts with carding teeth are situated on either side of said chain conveyers, set at an angle sufficient for the maximum coverage of the surface of the hide being processed, said teeth being also set at an acute angle to the tangent to the surface of the shaft in a direction opposite to its rotation. The apparatus comprises also a pair of rolls with ribs arranged along the generatrix on the surface of said rolls and coming in contact with the hide for the wringing of surface moisture therefrom. This design provides for higher productivity and better quality of the hides being processed.

7 Claims, 9 Drawing Figures

9
1
8
a
8
7

METHOD FOR CLEANSING CATTLE HIDES AND APPARATUS FOR REALIZING SAME

FIELD OF THE INVENTION

This invention relates to primary processing of animal hides, and more particularly to methods and means for cleansing cattle hides.

The invention can be most effectively used in the meat and leather industries, which set increased demands for surface cleanliness and cleansing quality.

BACKGROUND OF THE INVENTION

A method of hide cleansing is known, residing in washing the hides, soaking the dung with laying, knocking (scraping) the dung off, and repeated washing of hides with laying for the drip-off of the moisture.

This method fails to ensure adequate quality of hide processing, since scraping cannot completely remove the dung and a considerable part of it remains on the hair of the hide.

Besides, the hides contain after processing a considerable amount of surface moisture, requiring greater expenditure of salt and sodium fluosilicate during subsequent curing.

Another disadvantage of this method is the need for laying the hides for 60 to 90 minutes to soak the dung after washing, which prolongs the production cycle, increases labour intensity and rules out continuity of the process.

These drawbacks are partially removed in another prior art hide cleansing, whereby hides are washed in washing machines for soaking the dung, after which they are fed to a dung removing (or fleshing) machine intended for knocking or scraping the dung off. In this method, the washing of the hides in the washing drum takes place simultaneously with the soaking of the dung, which is then removed in an intermittent-action apparatus comprising a pair of transporting shafts for feeding the hides and shafts with a blade for removing the dung by scraping. (cf. U.S. Pat. No. 3,319,442; cl. 68-42, and the washing machine manufactured by the Stehling company, USA). Washing the hides in the washing drum makes it possible to partially mechanize the cleansing of hides, but the method entails increased expenditure of water though the soaking of the dung is inadequate. Moreover, during the rotation of the washing drum, an intensive mixing of hides takes place, resulting in the soiling of the flesh side of the hides with no way of cleaning them later, which impairs the hides' market value.

The above-described dung removing (or fleshing) machine does not provide for adequate hide treatment quality, since scraping off (knocking off) cannot fully remove the dung, a considerable part of which remains on the hair of the hide. Besides, this dung removal process involves much manual labour for loading the hides into the dung removing machine and unloading them therefrom. The method does not provide for the operation of removing surface moisture from the hides, which subsequently requires increased salt expenditure for curing them.

Thus, prior art cattle hide cleansing methods and equipment fail to ensure adequate hide cleansing quality; they prolong the production cycle, increase labor intensity and the expenditure of curing materials, and also rule out the performance of these processes in a continuous flow-line.

It is an object of the present invention to obviate the above disadvantages.

SUMMARY OF THE INVENTION

It is an object of the present invention to provide a method for cleansing cattle hides and apparatus for carrying out same, that would ensure continuous treatment of hides with adequate quality of processing their surface.

A further object of the invention is to ensure a high market value of the processed hides.

Another object of the invention is to ensure high-quality processing of hides while preserving their epidermis intact.

These and other objects are achieved by that in a method for cleansing cattle hides, their washing and soaking, and the removal of dung from their surface, according to the invention, are carried out simultaneously and continuously under copious irrigation with water, and, by moving the hides, their axis being essentially arranged along the direction of movement and secured in this position, while the removal of dung from the surface of the hides is effected by carding their hair covering with subsequent removal of the surface moisture.

An apparatus for carrying out the above method comprises a tank for washing the hides and soaking the dung and a means for removing the dung from said hides, and mounted, according to the invention, after said washing and soaking tank is a pair of belt conveyers parallel to each other and transporting the hides emerging from said tank to said dung removal means which comprises a pair of chain conveyers for grasping the hides and securing them along their axes, hair covering downwards, arranged one above the other, with one of them entering a clearing between said belt conveyers, and shafts bearing carding teeth are arranged on either side of the chain conveyers at an angle to the longitudinal axis of the apparatus, sufficient for said teeth to cover the maximum surface area of the hide being processed, each tooth being set at an acute angle to the tangent to the shaft's surface in a direction opposite to its rotation, and mounted above each of the shafts, along its longitudinal axis, is a hold-down member for maintaining the hide at the same distance from the teeth, adapted to move to and from the teeth to adjust the clearing therebetween according to the hide thickness, and having, after the last pair of shafts with carding teeth in the direction of hide travel, a pair of rolls with ribs arranged along their generatrices, on the surfaces thereof and coming in contact with the hides for removing surface moisture therefrom, and a means for spraying water onto the hides' hair covering is mounted between each pair of shafts and rolls.

The proposed method and apparatus provide for high-quality hide processing in a continuous flow and simultaneously, as a result of the hides being spread with their hair covering downwards on the continuously moving belt conveyers which feed them to the chain conveyers, likewise in continuous movement at a speed synchronous to that of said belt conveyers, for fixing the hides along their axial line and transporting them to the shafts with the carding teeth set at an angle to the apparatus longitudinal axis, each tooth being arranged in a staggered manner on the perimeter of the shaft and at an acute angle of about 50° to 70° to its tangent, pointing in the direction opposite to its rotation. It is precisely this arrangement of the shafts and teeth, that makes it possible to keep a hide stretched out and fully remove dung from the hide's hair covering without damaging it.

Quality cleansing of the hide is further facilitated by the presence of hold-down members above each of the shafts for keeping the hide at the same distance from the teeth, and the constant irrigation of said hides with water which, simultaneously with the carding, washes their surface and carries away the detached dung. Then, the chain conveyers move the hide on towards the ribbed rolls which wring out the surface moisture and carry said hide over a distance necessary for the next technological process, for example, curing.

According to the invention, the carding of a hide's hair covering is carried out at a given speed of the shafts and an angle of inclination of each tooth of about 50° to 70° to the longitudinal axis of the shaft in the direction opposite to the rotation thereof and to a depth essentially close to the hide's epidermis and adequate for the proper cleansing of the hide without damaging its surface.

According to the invention, the clamping of a hide by the chain conveyers is effected strictly along its axial line in the direction of its movement, which provides for complete cleansing of its more dirty lateral and marginal parts.

For loosening the dung simultaneously with soaking during the preliminary washing of the hides, according to the invention, compressed air is fed in under a pressure between 1.5 and 3 atm, since a pressure below 1.5 atm is not effective, while a pressure in excess of 3 atm causes the water in the tank to stir up and mix with the dung settling on the bottom and soil the hide's flesh side.

For reliable fixation of a hide between the links of the upper and lower chain conveyers, according to the invention, and also for excluding any damage to the hide by the chain conveyers during clamping, the lower chain conveyer has rubber cushions and pneumatic chambers consisting of a rubberised diaphragm, a metal disk, a rod and a thrust bearing, transmitting the pressure of the incoming compressed air to the rubber cushions.

BRIEF DESCRIPTION OF THE DRAWINGS

For a better understanding of the invention, a specific example of its embodiment will now be described with reference to the accompanying drawings, in which.

DETAILED DESCRIPTION OF THE INVENTION

Figures 1, 3:
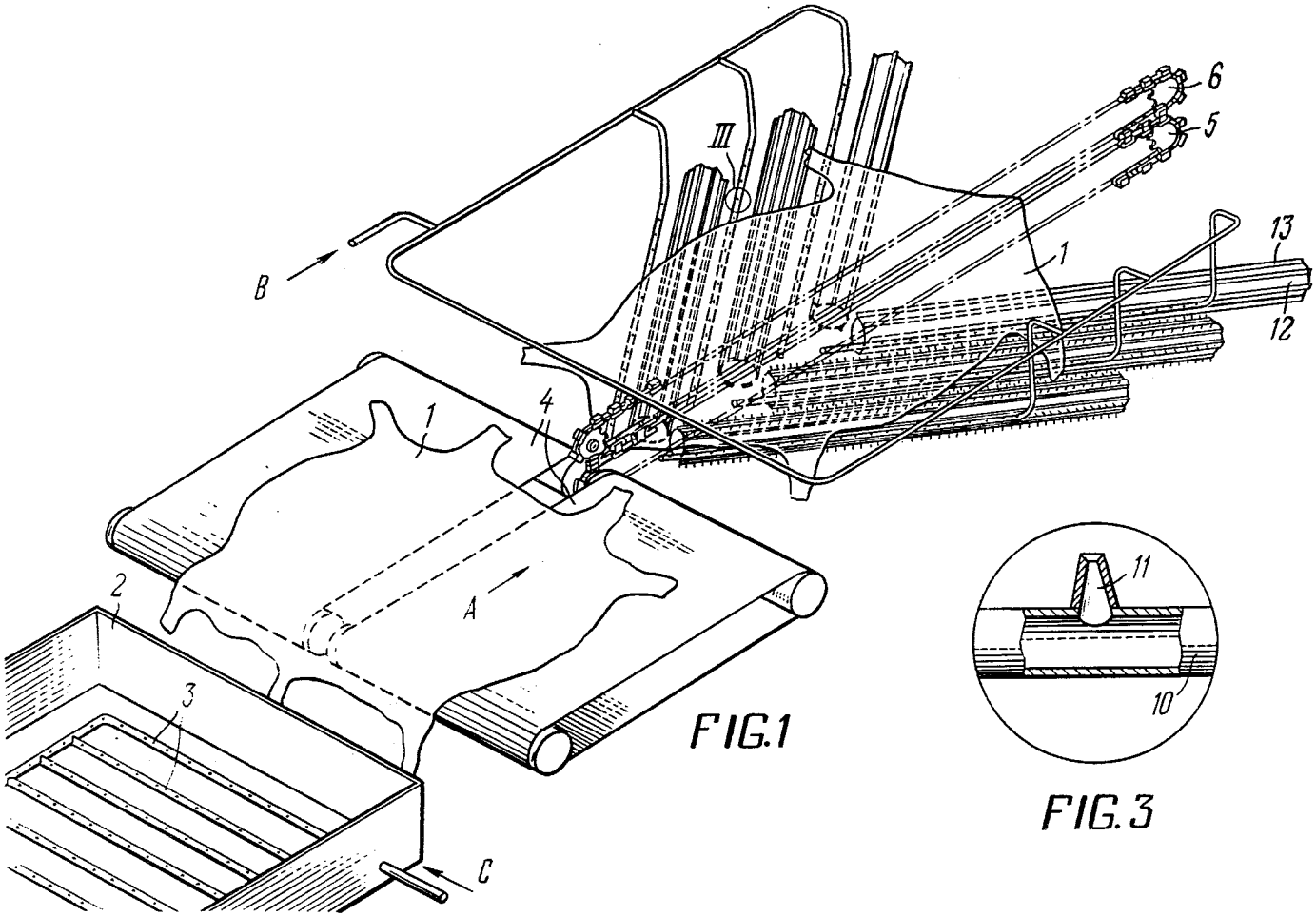
FIG. 1 is a diagrammatical representation of the apparatus for carrying out the proposed method for cattle hide cleansing.
FIG. 3 is a view, on an enlarged scale, of unit A of FIG. 1.

Cattle hides are processed in the following way: Hides 1 (FIG. 1) are continuously fed into a tank 2 with running water for the preliminary washing and partial soaking of dung. Compressed air is fed into the tank via a pipeline 3 for accelerating the process of loosening the dung. The constant passage through the water of bubbling compressed air under a pressure of 1.5 to 3 atm accelerates its movement, thus speeding up the loosening and softening of the dung on the hide.

Then the spread-out hides 1 are continuously fed onto belt conveyers 4 moving in parallel at a preset speed allowing complete cleansing of the hides.

Further on, each hide 1 in the flow along its axial line is grasped by a pair of chain conveyers 5 and 6 and is reliably clamped.

Figure 2:
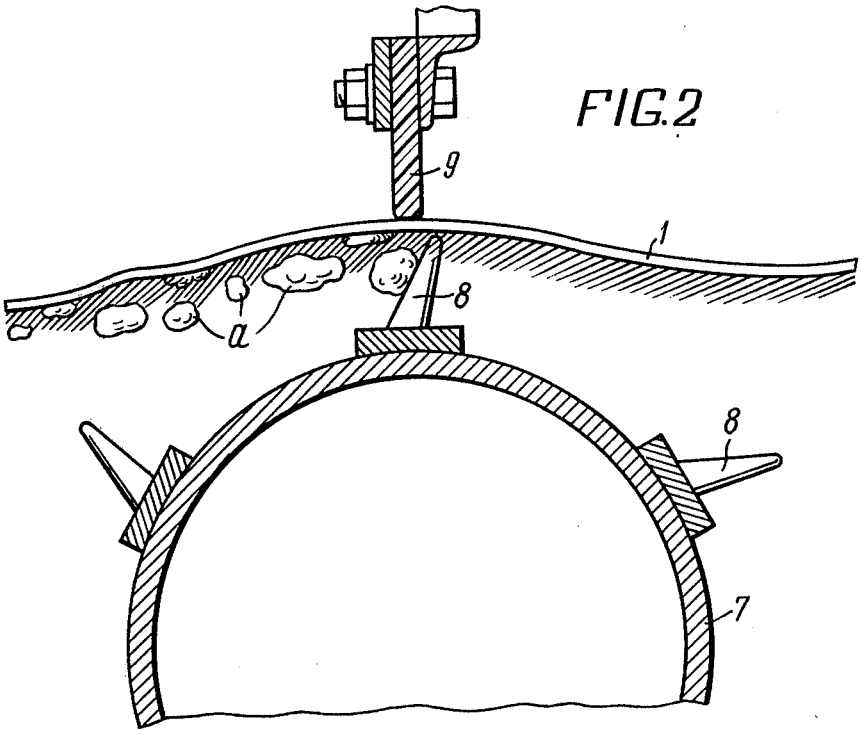
FIG. 2 shows the interaction of the teeth and the hold-down plate with a hide being processed.

One of the chain conveyers 5 enters the clearing between the belt conveyers 4, while the other chain conveyer 6 is situated above the chain conveyer 5. Due to synchronous operation of the belt and chain conveyers, the clamped hide 1 is smoothly drawn into the cleansing zone where it travels over shafts 7 with teeth 8 (FIG. 2), its hair covering downwards, while the teeth 8 completely remove dung "a" from the hide 1.

Maximum cleanliness of the hide surface is attained by carding the hide's hair covering with the teeth 8 secured on the shafts 7 and set at an acute angle in the direction opposite to the rotation of the shaft. This facilitates smooth entry of the teeth 8 into the hair covering of the hide 1, and removal of the dung "a", while the provision of a hold-down plate 9 ensures the penetration of the teeth into the hair covering to a depth close to its epidermis, without damaging it.

Meanwhile, a system of pipelines 10 and nozzles 11 copiously irrigates the hide surface being processed with water fed under a definite pressure (FIG. 3).

Further on, the chain conveyers 5 and 6 move the hides 1 over rolls 12 with ribs 13 (FIG. 1) for the removal of surface moisture.

Surface moisture is wringed from the hide 1 due to the latter being pressed by the hold-down plate 9 to the ribs 13 secured on the rolls 12 at the same angle as the teeth 8 on the shafts 7 and which rotate at the same speed.

Thus, high-quality cleansing of the hair covering of hides without damaging them can only be carried out by the above described method of processing, whereby the carding shafts are arranged at a pre-set angle to the axial line of the apparatus in the horizontal plane, all the teeth being set on the perimeter of the shaft in a staggered manner at an acute angle, pointing in the direction opposite to the rotation of the shaft, and the carding of the hair covering goes on simultaneously with the irrigation of the hide surface with water, said surface being kept by the hold-down members at the same distance from the carding teeth, according to the thickness of the hide.

The thoroughly cleansed and wringed hide 1 is moved on by means of the chain conveyers 5 and 6 for the next technological operation, for example, curing.

The movement of the hide is conditionally designated in the drawing by arrow A, the water supply, by arrow B, and the air supply, by arrow C.

Figure 4:
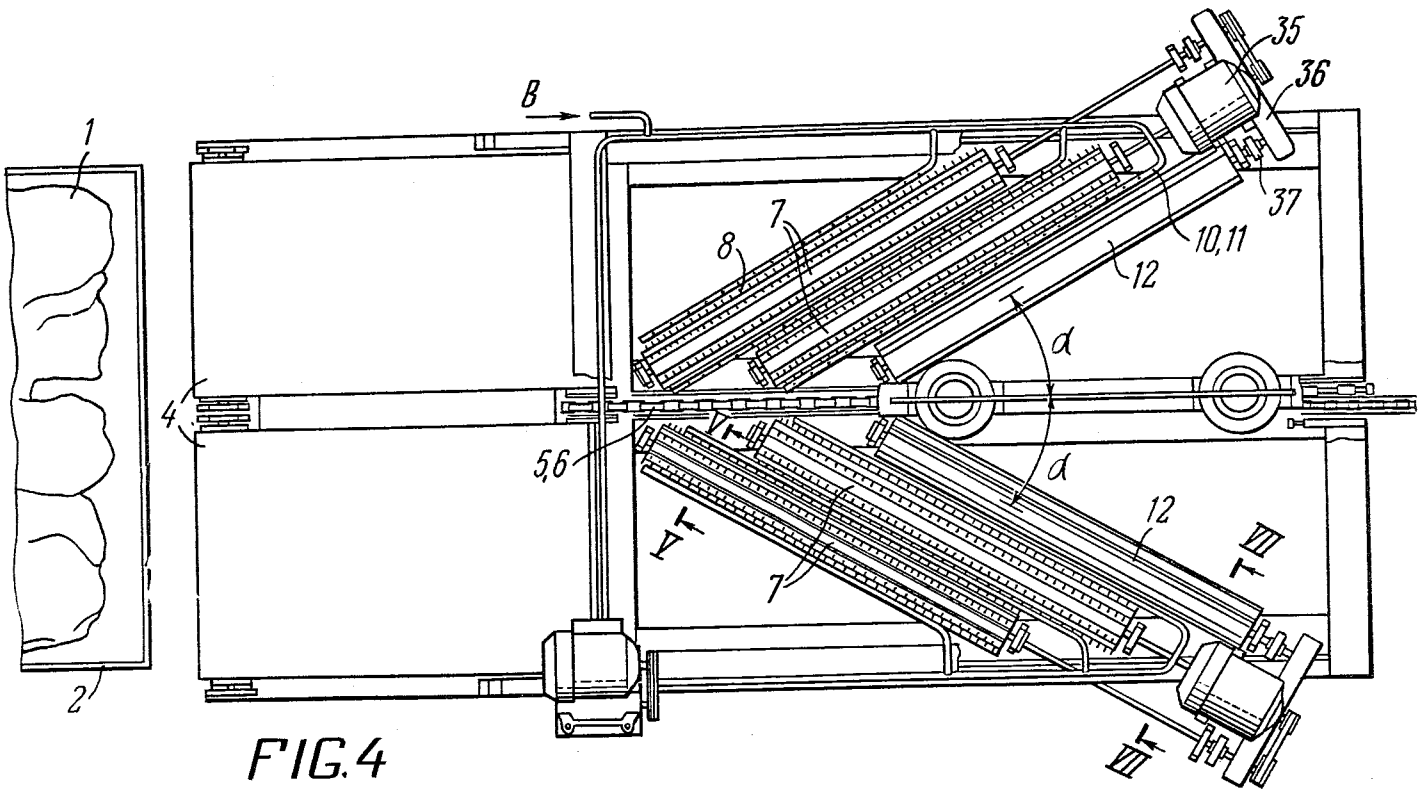
FIG. 4 is a top diagrammatical view of the apparatus for carrying out the method of hide cleansing.

The apparatus for carrying out the above method comprises a tank 2 (FIG. 4) intended for preliminary washing and partial soaking of dung on hides 1.

Mounted after said tank, in the direction of the hide's movement, are belt conveyers 4 for transporting the hides and feeding them to the pair of chain conveyers 5 and 6, situated behind said belt conveyers 4. The conveyer 5 enters the clearing between the belt conveyers for grasping the hides. Situated on either side, of the chain conveyers 5 and 6 are the horizontally arranged shafts 7 with the teeth 8, secured in a staggered manner on the surface of the shafts.

The shafts 7 are set at an angle $\alpha$ to the apparatus' longitudinal axis, sufficient for covering the maximum surface area of the hide being cleansed by the teeth 8 and for keeping the hide stretched while being treated.

Figure 5:
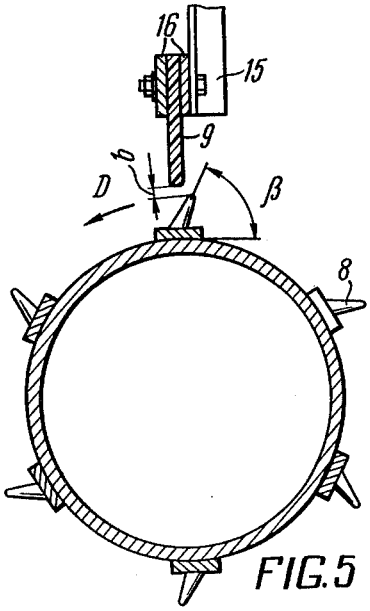
FIG. 5 is a section along line V—V of FIG. 4.

The teeth 8 (FIG. 5) are set at an acute angle $\beta$ to the tangent to the surface of the shaft, pointing in the direction opposite to its rotation. The rotation of the shaft is conventionally indicated in the drawing by arrow D. The angle $\beta$ lies within the range from 50° to 70° and is selected such as to ensure the penetration of the teeth 8 close to the epidermis and adequate for high-quality cleansing of the hide without damaging its surface.

A hold-down member in the form of a plate 9 is mounted over each shaft 7 along its longitudinal axis and intended for keeping the hide at an equal distance from the teeth 8.

Figure 6:
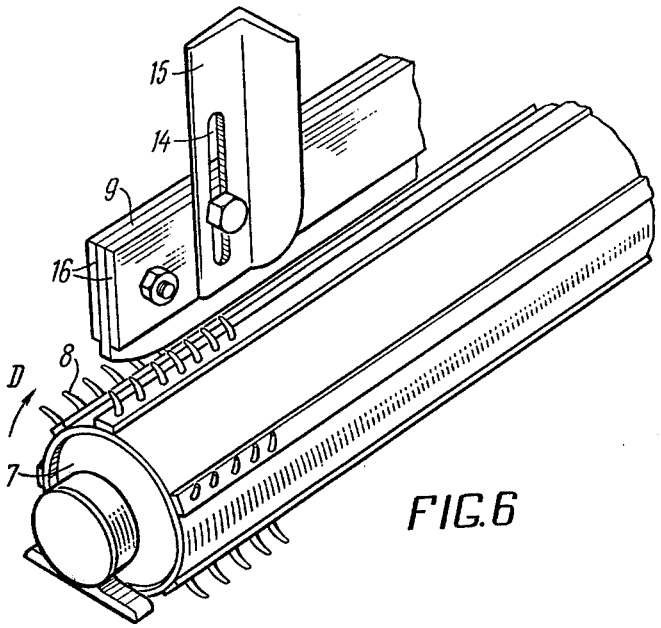
FIG. 6 shows the arrangement of the hold-down plate and the toothed shaft in relation to each other.

The plate 9 (FIG. 6) is mounted movably to or from tooth 8, for which it is set in a slot 14, made in a bracket 15 and secured between metal plates 16.

This movability of the plate is necessary for adjusting the clearance b (FIG. 5) between said plate and the tooth, depending on the thickness of the hide, and also to compensate for the wear and tear of the plate and teeth.

Figure 7:
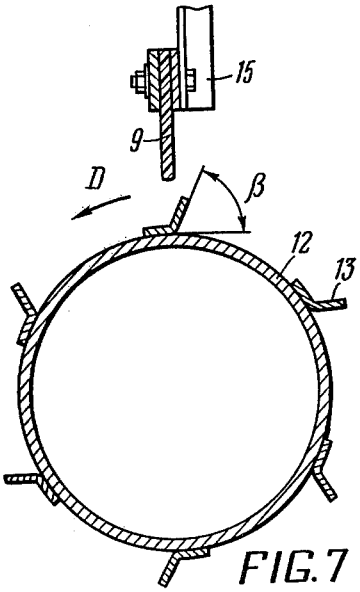
FIG. 7 is a section along line VII—VII of FIG. 4.

Following the last pair of the shafts 7, in the direction of the hide's movement, a pair of rolls 12 (FIG. 1) is set with ribs 13 arranged on their surfaces along the generatrices. The ribs 13 (FIG. 7) are inclined to the longitudinal axis of a roll 12, just as the teeth 8 are, at an angle $\beta$ and are intended for the removal of surface moisture from the hide. The hide is pressed against the ribs 13 of the rotating rolls 12 by the hold-down plate 9 similar to the way it is pressed to the shafts 7.

A means for water spraying, comprising a system of pipelines 10 and nozzles 11 (FIG. 3) is set between each pair of shafts 7 and rolls 12.

Figure 8:
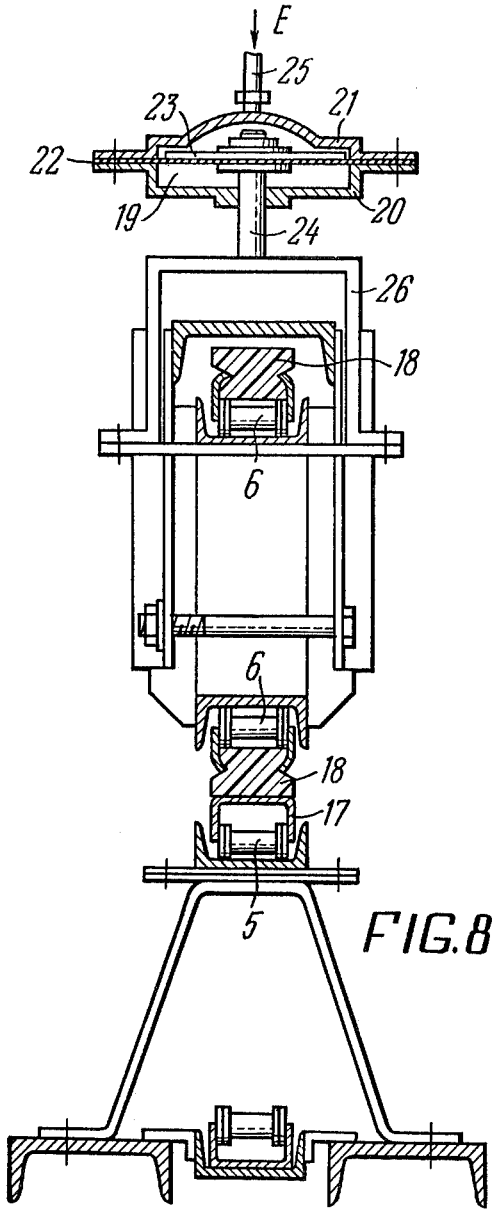
FIG. 8 is a cross-section view of the chain conveyers.

To exclude any damage to the hides by the chain conveyers 5 and 6 (FIG. 8) and for reliably clamping them therebetween, the lower conveyer 5 has bracket-shaped plates 17, and the upper conveyer 6 has rubber cushions 18 and pneumatic chambers 19 intended for feeding compressed air to the rubber cushions 18.

A pneumatic chamber consists of half-chambers 20 and 21 with a diaphragm 22 and a metal disk 23 therebetween. The pneumatic chamber also has a rod 24 and a pipeline 25 for feeding compressed air in the direction conventionally indicated by arrow E. The rod 24 actuates a yoke 26 fastened on the frame of the chain conveyer 6.

Figure 9:
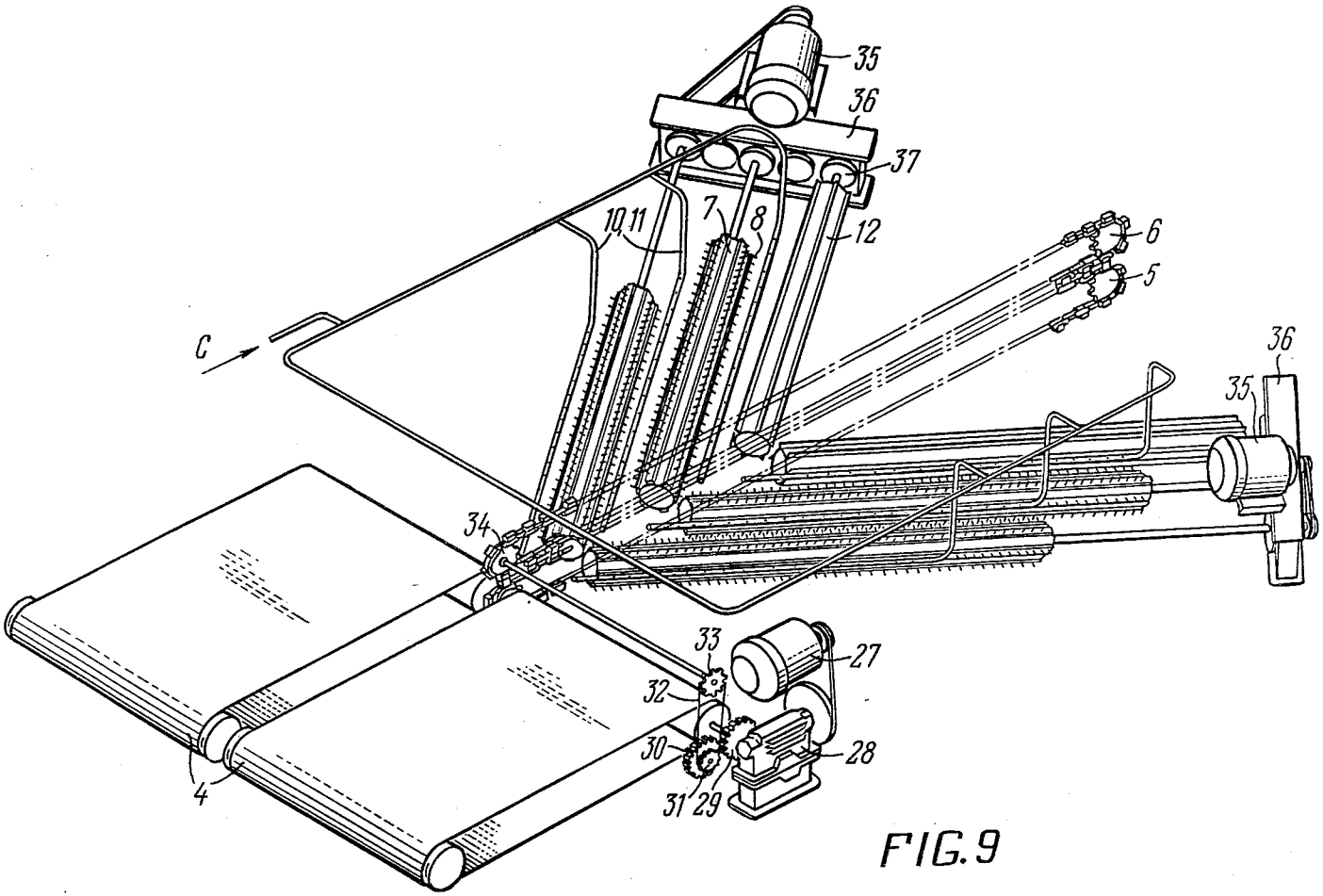
FIG. 9 is a kinematic diagram of the proposed apparatus.

The apparatus is fitted with means for driving the belt conveyers 4 and the chain conveyers 5 and 6. The belt conveyers 4 are driven by an electric motor 27 (FIG. 9) through a reducing gear 28. A gear 29 on the output shaft of the reducer 28 is engaged with a gear 30 which is blocked with a sprocket 31, linked through a chain 32 with another sprocket 34 which actuates the chain of the upper conveyer 6.

The shafts 7 and rolls 12 are rotated by an electric motor 35 through a reducing gear 36 which has a clutch 37 set on its output shaft.

OPERATION OF THE APPARATUS

The belt conveyers 4 and chain conveyers 5 and 6 are actuated from the electric motor 27 through the reducing gear 28 and further by means of the elements 31 to 34.

The shafts 7 with the carding teeth 8 and the rolls 12 with the ribs 13 are rotatable upon the switching on of the electric motors 35, transmitting rotation to the reducing gears 36 through the clutch 37.

Water is simultaneously fed into the pipeline system 10 with the nozzles 11 for spraying the hides in the process of their cleansing.

In order to secure the hides between the chain conveyers 5 and 6 along the axial line for their further transportation, compressed air is fed into the pneumatic chambers 19, which through the rod 24 and yoke 26 acts upon the upper chain conveyer 6, thereby ensures the clamping of the hide to the lower chain conveyer.

Upon starting the apparatus, a hide 1 is placed with its hair covering downwards onto the belt conveyers 4 which feed it to the chain conveyers 5 and 6 for clamping and further transportation to the shafts 7 with the teeth 8 and the rolls 12 with the ribs 13, rotating at a preset speed in a direction opposite to the movement of the hides which are subjected all the time to carding by the teeth 8, irrigation with water from the nozzles 11 and wringing by the ribs 13, all of which ensures proper cleanliness of the hair covering of the hides 1 and the wringing of surface moisture therefrom.

What is claimed is:

1. A method for cleansing hair covered hides comprising the steps of:

fixing a hide for movement and moving the hide substantially along its axis of symmetry;

simultaneously irrigating the hide and carding the hide's hair covering while the hide is moving along its axis of symmetry, thereby washing the hide and soaking while simultaneously removing foreign material adhering to the hair side of the hide; and removing surface moisture from the hide.

2. A method as recited in claim 1 including the further step of prior to substantially irrigating and carding the hide, subjecting the hide to a preliminary washing.

3. A method as recited in claim 2 wherein said preliminary washing step comprises disposing the hide in a liquid-filled tank and introducing compressed air into the tank under a pressure of between 1.5 to 3 atmospheres.

4. A method as recited in claim 1 wherein said carding step is effected by moving a plurality of teeth through the hide hair in a direction opposite to the direction of travel of the hide, the teeth extending to a depth close to the epidermis of the hide.

5. A method as recited in claim 4 wherein said carding step further includes urging the hide towards the teeth to a predetermined extent so that the teeth extend to said depth.

6. A method as recited in claim 1 wherein said simultaneous irrigating and carding steps are effected by locating a plurality of rotatable carding rolls beneath the hide and spraying the hide from locations interposed between the carding rolls.

7. A method as recited in claim 6 wherein said carding rolls are located in a manner whereby each of their longitudinal axes extend at an acute angle with respect to the direction of movement of the hide.

* * * * *